219-121 SR
4/19/88 OR 4,739,147

United States Patent [19]
Meyer et al.

[11] Patent Number: 4,739,147
[45] Date of Patent: Apr. 19, 1988

[54] PRE-ALIGNED DEMOUNTABLE PLASMA TORCH

[75] Inventors: Gerhard A. Meyer; Harold W. Eberhart, both of Midland; Laurence F. Novak, Sanford, all of Mich.

[73] Assignee: The Dow Chemical Company, Midland, Mich.

[21] Appl. No.: 8,809

[22] Filed: Jan. 30, 1987

[51] Int. Cl.[4] ..... B23K 9/00
[52] U.S. Cl. ..... 219/121 PM; 219/121 P; 219/121 PR; 315/111.51
[58] Field of Search ..... 219/121 PR, 121 P, 121 PM, 219/121 PQ, 121 PP, 74, 75, 76.16, 76.15, 121 PN; 313/231.31, 231.51, 231.41; 315/111.21, 111.51

[56] References Cited

U.S. PATENT DOCUMENTS

| | | | |
|---|---|---|---|
| 4,035,604 | 7/1977 | Meleka et al. | 219/121 PR |
| 4,551,609 | 11/1985 | Falk | 219/121 PR |
| 4,575,609 | 3/1986 | Fassel et al. | 219/212 PR |
| 4,578,560 | 3/1986 | Tanaka et al. | 219/121 PR |

OTHER PUBLICATIONS

Cobbold, David G., "Comments on the Analytis of High-solids Matrices Using the Meinhard Concentric Nebulizer in ICP Atomic Emission Spectroscopy," *Applied Spectroscopy,* vol. 40, No. 8, pp. 1242–1244, 1986.

Borsier, M. et al., "La R'egulation Automatique Des D'ebits De Gainage Et De N'ebulisation Dans un Plasma a' Couplage Inductif: un Gain De Stabilit'e Pour l'Analyse De Routine en Prospection G'eochimique," *Spectrochimica Acta,* vol. 41B, Nos. 1/2, pp. 115–123, 1986, printed in Great Britain.

Windsor, D. L. et al., "A High Power Inductively Coupled Plasma Torch and Impedance Matching Network," Applied Spectroscopy, vol. 33, No. 1, pp. 56–58, 1979.

Publication of the Perkin Elmer Demountable Plasma Torch, pp. 6, 8, and 12, (this reference is not dated).

Publication of the Allied Systems Semi-Demountable Plasma Torch, (this reference is not dated).

*Primary Examiner*—M. H. Paschall
*Attorney, Agent, or Firm*—Timothy S. Stevens

[57] ABSTRACT

An improved pre-aligned demountable plasma torch wherein the three tubes that are generally used in demountable plasma torches are now joined together with standard taper joints. The axis of the standard taper joints are essentially centrally aligned with the central long axis of the tubes so that the tubes are pre-aligned and essentially concentric in the assembled torch. If any of the tubes becomes damaged in use they can be replaced with a similarly constructed tube with a minimum of interruption and expense, without the need to adjust the tubes to be essentially concentric and in an assembly consisting of only 3 parts.

6 Claims, 2 Drawing Sheets

PRE-ALIGNED DEMOUNTABLE PLASMA TORCH

BACKGROUND OF THE INVENTION

The invention is in the field of ionized gas plasma torches used for example in conjunction with an optical spectrometer or with a mass spectrometer for the purpose of elemental analysis and specifically to torches having replaceable parts.

Plasma elemental analysis is an important branch of chemical analysis. The plasma is generated in a device called a torch (or burner) and a sample is introduced into the plasma so that elements of the sample are atomized by the plasma and detected by a number of techniques. Most torches comprise three concentric tubes. The outer tube contains the plasma and is generally a quartz tube which can withstand the relatively high temperatures to which it is exposed. The intermediate tube is positioned concentric within the outer tube, and terminates within the outer tube and also is generally a quartz tube. A flow of plasma gas, such as argon, is flowed in the intermediate tube and the plasma is generated for example by inductive coupling of radio frequency energy to the ionized gas so that the resulting plasma is above the intermediate tube and within the outer tube. The inner tube is concentric within the intermediate tube and also terminates within the outer tube so that a sample, generally in the form of an aerosol, can be flowed in the inner tube and then into the plasma. The heat of the plasma can melt the outer tube and to prevent this coolant gas, generally argon, is flowed in the annulus between the outer tube and the intermediate tube and at a relatively high velocity so that the plasma is kept away from the inner surface of the outer tube and to cool the outer tube. The flow of gas in this annulus and the annulus between the intermediate tube and the inner tube is conventionally helical in practice by introducing the gases to the tubes tangentially to the axis of the tubes. The position of the intermediate tube with respect to the other tubes is critical. Ideally, the tubes are exactly concentric so that the plasma is concentric in the torch. In practice, some tolerance in concentricity is allowable as long as the plasma is essentially concentric in the torch as is well understood in the art. In addition, the inner tube should also be concentric in the intermediate tube so that the sample is introduced into the center of the plasma under well defined conditions. Due to the larger annulus area between the inner tube and the intermediate tube than between the outer tube and the intermediate tube, less precision is required with the concentricity of the inner tube in the intermediate tube than with the concentricity of the intermediate tube in the outer tube (although near perfect concentricity is always most preferred).

Many torches are constructed by glass blowers entirely of quartz tubing. The glass blower carefully aligns the tubes so that they are essentially concentric during fabrication and thereafter the tubes remain frozen in alignment. However, a problem with this type of torch occurs when one of the tubes is damaged or deteriorates with use, for example by the devitrification of the intermediate tube, limiting its analytical utility. Then the whole torch must be removed from service and the torch discarded or it can be repaired by a glass blower, at a cost typically greater than the original price of the torch. In addition, with this type of torch the experimenter is locked into a fixed configuration of the torch and is unable to conveniently alter the shape or size of any of the tubes of the torch for the purposes of optimizing its use. Demountable torches were developed to overcome these problems by removably mounting the tubes in a base.

A problem with prior demountable torches was the need to align the intermediate and outer tubes after replacing one or the other. With the Perkin Elmer Demountable Torch, for example, initial alignment is accomplished with a tool that is inserted in the annulus between the outer and intermediate tubes while adjusting three screws that bear radially on the outer tube. This initial adjustment is then fine tuned during use of the torch, if necessary, by further adjustment screw turning to obtain an essentially concentric plasma in the torch. This is often time consuming and skill intensive.

A solution to the alignment problem in demountable torches was the demountable torch described by Windsor et al. in Applied Spectroscopy, Vol. 33, 1979, on pages 56–58, wherein the outer and intermediate tubes were aligned by a series of spacers, inserts, 0-rings and collars. Windsor et al stated on page 57 "Precise alignment of the glass-blown torch can be achieved during construction through the use of an assembly jig. However, this type of torch is not easily repaired should problems be encountered. The dismantable base approach can be difficult to align if the three tubes are held only near the bottom. This problem is aggravated by the fact that rarely is commercial quartz and Pyrex glass tubing perfectly straight or cylindrical. A torch design which is both dismantable and self-aligning has been used successfully in this laboratory for several years. A unique feature is the use of nylon or Teflon slip fit spacers between the sample and plasma gas tubes and the plasma and coolant gas tubes." While this torch may have solved the alignment problem it was also composed of over 20 parts. It would be more desirable if a demountable pre-aligned torch were composed of fewer parts, and its success in use be more independent of operator skill.

Semi-demountable torches are torches having fixed outer and intermediate tubes and a replaceable inner tube. The Allied Systems ICP torch is an example of a semi-demountable torch which has a boron nitride base onto which the outer and intermediate tubes are permanently fixed while the inner tube is removably positioned in the base.

The present invention is a demountable torch comprising pre-aligned intermediate and outer tubes, as few as three parts and no base. This is accomplished by the use of tubes having precision aligned conical joints, preferably the well known standard taper precision ground quartz type joint.

SUMMARY OF THE INVENTION

The basic invention is an improved pre-aligned demountable plasma torch comprising an outer tube and an intermediate tube joined together by inversely mated conical surfaces. The outer tube has a conically shaped section whose axis is essentially centrally aligned with the axis of the outer tube. The intermediate tube terminates within the outer tube and has a conically shaped section whose axis is essentially centrally aligned with the axis of the intermediate tube. The conically shaped section of the outer tube is inversely mated to the conically shaped section of the intermediate tube so that the intermediate tube is essentially concentric in the outer tube and so that the intermediate tube can be readily disassembled from the outer tube and reassembled thereto. The intermediate and outer tubes need to be constructed of a heat resistant material such as quartz, boron nitride or fused silica.

The basic invention can additionally comprise an outer tube having an additional conically shaped section whose axis is essentially centrally aligned with the axis of the outer tube and an inner tube having a conically shaped section whose axis is essentially centrally aligned with the axis of the inner tube. The conically shaped section of the inner tube is inversely mated to the additional conically shaped section of the outer tube so that the inner tube can be readily disassembled from the outer tube and reassembled thereto. The inner tube of this embodiment of the invention needs to be constructed of a heat resistant material such as quartz, boron nitride, graphite or fused silica.

The basic invention can alternatively additionally comprise an intermediate tube having an additional conically shaped section whose axis is essentially centrally aligned with the axis of the intermediate tube and an inner tube having a conically shaped section whose axis is essentially centrally aligned with the axis of the inner tube. The conically shaped section of the inner tube is inversely mated to the additional conically shaped section of the intermediate tube so that the inner tube can be readily disassembled from the intermediate tube and reassembled thereto. The inner tube of this embodiment of the invention also needs to be constructed of a heat resistant material such as quartz, boron nitride, graphite or fused silica.

BRIEF DESCRIPTION 0F THE DRAWINGS

DETAILED DESCRIPTION OF THE INVENTION

Figure 1:
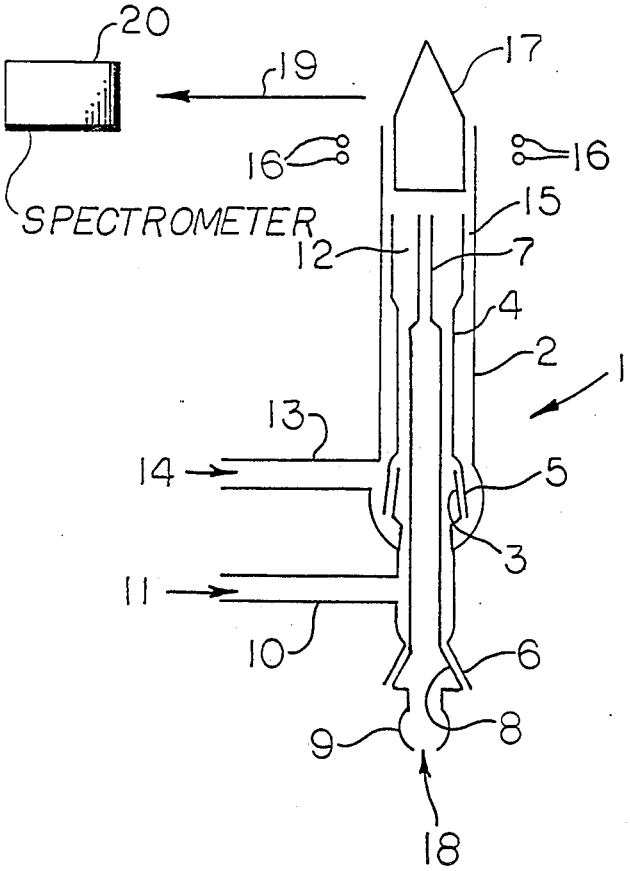
FIG. 1 is a cross sectional view of one embodiment of the invention.

Referring to FIG. 1 therein is shown a cross sectional view of a plasma torch 1 which is one embodiment of the invention. The torch 1 has an outer tube 2 having a conical section 3. The axis of the conical section 3 is essentially centrally aligned with the axis of the outer tube 2. An intermediate tube 4 has a conical section 5. The axis of the conical section 5 is essentially centrally aligned with the axis of the intermediate tube 4. The conical section 3 is the inverse of the conical section 5 so that preferably an essentially leak tight joint is made between the tube 4 and the tube 2. In addition, since the conical sections 3 and 5 are essentially centrally aligned with the axes of the tubes 2 and 4, the intermediate tube 4 is effectively concentric in the outer tube 2. As with most plasma torches currently in use the preferred material of construction of the tubes 2 and 4 is quartz which is able to withstand relatively high temperatures. However, the tubes 2 and 4 can be made of other materials such as fused silica or a ceramic like boron nitride.

The torch 1 further includes an additional conical section 6. The axis of the conical section 6 is essentially centrally aligned with the axis of the outer tube 2. An inner tube 7 has a conically shaped section 8. The conically shaped section 8 is essentially centrally aligned with the axis of the inner tube 7. The conically shaped section 6 is the inverse of the conically shaped section 8 so that preferably an essentially leak tight joint is made between the tube 2 and the tube 7. In addition, since the conically shaped sections 6 and 8 are essentially centrally aligned with the axes of the tubes 2 and 7, the inner tube 7 is effectively concentric in the outer tube 2. The tube 7 has a ball joint 9 at the one end. As with most plasma torches currently in use the preferred material of construction of the inner tube 7 is quartz. However, the tube 7 can be made of other heat resistant materials such as fused silica, graphite or boron nitride.

A side neck 10 is conventionally tangentially connected to the tube 2 on torch 1 to allow the input of a plasma gas 11 which flows in a helical manner up the inside of the intermediate tube 4 and through an annulus 12 between the intermediate tube 4 and the inner tube 7. A side neck 13 is conventionally tangentially connected to the tube 2 to allow the input of coolant gas 14 which flows in a helical manner up the inside of the outer tube 2 and through an annulus 15.

During the operation of the torch 1, radio frequency electricity is input to a coil 16 to inductively couple energy into the plasma gas 11 so that a plasma 17 forms. The coolant gas 14 primarily keeps the plasma 17 from melting the outer tube 2. The concentricity of the tube 4 in the tube 2 insures that the plasma 17 is essentially concentric in the torch 1. Alternatively, other means than the coil 16 can be used to sustain the plasma 17 such as microwaves and electric arcs. A nebulized sample 18 is flowed up the inside of the inner tube 7 so that the sample 18 is introduced into the plasma. The sample 18 is heated by the plasma 17 and emits light 19 that is read by a spectrometer 20. Alternatively, ionized material generated in the plasma 17 can be introduced into a mass spectrometer or other analytical means, not shown.

Figure 2:
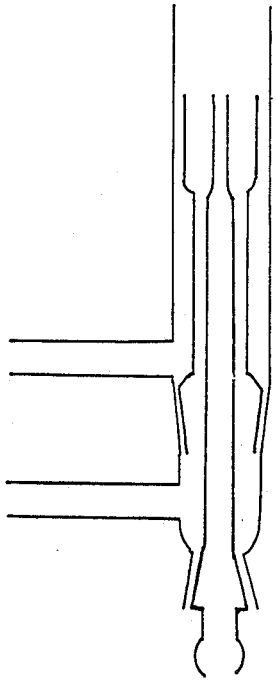
FIG. 2 is a cross sectional view of another embodiment of the invention.

Referring to FIG. 2, therein is shown a cross sectional view of another embodiment of the invention showing an inverse relationship between the conical sections that mate the intermediate tube and the outer tube relative to the example shown in FIG. 1. The embodiments of the invention shown in FIGS. 1 and 2 are preferred when replacement of the inner and intermediate tubes is likely to be needed and the torch is held during use by attachment to the outer tube.

Figure 3:
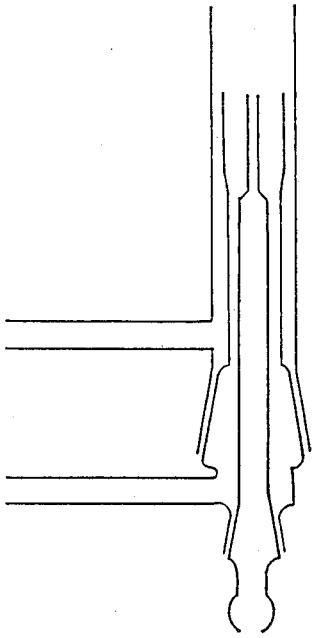
FIG. 3 is a cross sectional view of yet another embodiment of the invention.

Referring to FIG. 3, therein is shown a cross sectional view of yet another embodiment of the invention showing an outer tube having at one end a conical section inversely mated to a conical section on the intermediate tube.

Figure 4:
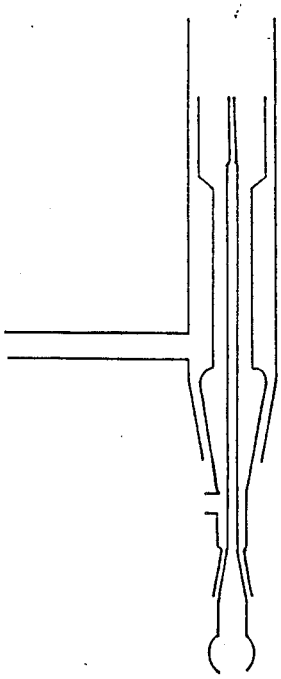
FIG. 4 is a cross sectional view of further yet another embodiment of the invention.

Referring to FIG. 4, therein is shown a cross sectional view of further yet another embodiment of the invention showing an inverse relationship between the conical sections that join the intermediate tube and the outer tube relative to the example shown in FIG. 3. The embodiments of the invention shown in FIG. 3 and 4 are preferred when replacement of the inner and outer tubes is likely to be needed and the torch is held during use by attachment to the intermediate tube.

The conical sections of the invention are preferably standard taper precision ground glass type joint surfaces (ground or polished surface). Standard taper joints are commercially available from several scientific glass companies in materials including quartz. The preferred way to fabricate the preferred outer and intermediate tubes of the invention is to weld such quartz joints to precision quartz tubing in such a way that the axis of the standard taper joint is essentially centrally aligned with the axis of the tubing. One way to do this is to mount the standard taper joint on an inversely mated standard taper Invar alloy mandrel and mount the mandrel in the tailstock of a precision glass blowing lathe. A section of precision quartz tubing is then mounted in the chuck of the lathe and centered for minimum run out. Then the tube and the joint are brought together and welded using standard glass blowing techniques for welding quartz parts together. FIG. 2 shows a highly preferred embodiment of the invention.

EXAMPLE 1

The torch shown in FIG. 2 is fabricated by a glass blower. The intermediate tube is made by the following steps. The tube stock from a male 14/35 quartz standard taper joint (available from Quartz Scientific, Inc. Fairport Harbor, Ohio) is removed and the joint itself is shortened to 14/18 size. The joint is mounted in a 14/18 female standard taper Invar alloy mandrel and the mandrel is mounted in the tailstock of a precision glass blowing lathe. A 2 inch long section of 11 mm O.D., 9 mm I.D. precision quartz tubing (available from Quartz Scientific, Inc. (QSI) is centered in the chuck of the lathe and the tubing and the joint are welded together using a glass blowing torch. Then the chuck is opened to allow removal of the tubing and the tubing end is flared to an 0.D. of 16 mm. A 4 inch length of 16 mm 0.D. 14 mm I.D. precision quartz tubing (available from QSI) is then centered in the chuck of the lathe and the flared tubing is welded to the chucked tubing using a glass blowing torch. The intermediate tube is completed by shortening the 16 mm O.D. section to ¾ inch in length. Another intermediate tube is also made, as described above, as a spare.

The inner tube is made by the following steps. The tube stock from a male 10/30 quartz standard taper joint (available from QSI) is removed and the joint itself is shortened to 10/12 size. The joint is then mounted in a 10/12 female standard taper Invar alloy mandrel and the mandrel is mounted in the tail stock of a precision glass blowing lathe. A 2 inch long section of 8 mm 0.D., 5 mm I.D. precision quartz tubing (available from QSI) is centered in the chuck of the lathe and the tubing and the joint are welded together using a glass blowing torch. Then the welded part is removed from the lathe and the 8 mm tube section is centered in the tailstock of the lathe and a 3 inch long section of 6 mm 0.D., 4 mm I.D. precision quartz tubing is centered in the chuck of the lathe and the other end of the joint and the tubing are welded together using a glass blowing torch. The tubing is then withdrawn from the chuck of the lathe and a 2 inch length of 6 mm 0.D., 2 mm I.D. precision quartz tubing (available from QSI) is centered in the chuck of the lathe and welded to the 6 mm 0.D., 4 mm I.D. tubing. The inner tube is completed by shortening the 6 mm 0.D., 2 mm I.D. section to ¾ inch in length and by shortening the 8 mm section of tubing to ¼ inch in length and welding thereto a 12/5 quartz ball joint (available from QSI). Another inner tube is also made, as described above, as a spare.

The outer tube is made by the following steps. The tube stock from a female 14/35 quartz standard taper joint (available from QSI) is removed and the joint itself is shortened to 14/18 size. The joint is then mounted in a 14/18 male standard taper Invar alloy mandrel and the mandrel is mounted in the tailstock of a precision glass blowing lathe. A 3 inch length of 16 mm 0.D, 14 mm I.D. precision quartz tubing (available from QSI) is centered in the chuck of the lathe and welded to the joint. Then the mandrel is removed and a 3.5 inch length of 20 mm 0.D., 18 mm I.D. precision quartz tubing (available from QSI) is centered in the tailstock of the lathe and welded to the other end of the 14/18 joint. The work is then removed from the chuck of the lathe and the 16 mm 0.D. section of tubing is shortened to ¾ inch in length. Then the exposed end of the 16 mm 0.D. tubing is reduced in 0.D. to 10 mm. The tube stock from a female 10/30 quartz standard taper joint (available from QSI) is removed and the joint itself is shortened to 10/12 size. The joint is then mounted in a 10/12 male standard taper Invar alloy mandrel and the mandrel is mounted in the chuck of the lathe and the two pieces are welded together. The outer tube is completed by welding 6 mm O.D., 4 mm I.D. quartz tubing (available from QSI), ¾ inch in length, tangentially to the outer tube immediately above and below the 14/18 standard taper joint as shown in FIG. 2. Another outer tube is also made, as described above, as a spare.

A torch is assembled by inserting one of the inner tubes and one of the intermediate tubes into one of the outer tubes so that the joints of each mate together. The intermediate tube is effectively concentric in the outer tube and the inner tube is effectively concentric in the intermediate tube so that when a plasma is generated in the torch it is essentially concentric in the torch and so that a sample can be introduced into the center of the plasma.

EXAMPLE 2

The torch of Example 1 is installed in a RF Plasma Products, Inc. ICP 5000 instrument. A plasma is ignited in the torch but by mistake too low a flow rate of plasma gas is used and as a result the intermediate tube overheats and becomes distorted. The distorted intermediate tube is removed from the torch and replaced with the spare intermediate tube. A concentric plasma is properly ignited in the torch and an analysis of elements in a sample is resumed without significant delay.

What is claimed is:

1. In an improved pre-aligned demountable plasma comprising an inner tube, an intermediate tube and an outer tube, wherein the improvement comprises:
   (a) the outer tube having a conically shaped section whose axis is essentially centrally aligned with the axis of the outer tube:
   (b) the intermediate tube having a conically shaped section whose axis is essentially centrally aligned with the axis of the intermediate tube, the conically shaped section of the outer tube inversely friction fit mated to the conically shaped section of the intermediate tube so that the intermediate tube is essentially concentric and prealigned in the outer tube and so that the intermediate tube can be readily disassembled from the outer tube and reassembled thereto in pre-aligned fashion.

2. The improved torch of claim 1 wherein the outer tube and the intermediate tube comprise a material selected from the group consisting of quartz and fused silica.

3. The improved torch of claim 1 wherein the outer tube has an additional conically shaped section whose axis is essentially centrally aligned with the axis of the outer tube and further comprising the inner tube having a conically shaped section whose axis is essentially centrally aligned with the axis of the inner tube, the conically shaped section of the inner tube inversely friction fit mated to the additional conically shaped section of the outer tube so that the inner tube can be readily disassembled from the outer tube and reassembled thereto.

4. The improved torch of claim 3 wherein the inner tube comprises a material selected from the group consisting of quartz, fused silica, boron nitride and graphite.

5. The improved torch of claim 1 wherein the intermediate tube has an additional conically shaped section whose axis is essentially centrally aligned with the axis of the intermediate tube and further comprising the inner tube having a conically shaped section whose axis is essentially centrally aligned with the axis of the inner tube, the conically shaped section of the inner tube inversely friction fit mated to the additional conically shaped section of the intermediate tube so that the inner tube can be readily disassembled from the outer tube and reassembled thereto.

6. The improved torch of claim 5 wherein the inner tube comprises a material selected from the group consisting of quartz, fused silica, boron nitride and graphite.

* * * * *

UNITED STATES PATENT AND TRADEMARK OFFICE

CERTIFICATE OF CORRECTION

PATENT NO. : 4,739,147

DATED : April 19, 1988

INVENTOR(S) : Gerhard A. Meyer; Harold W. Eberhart; Laurence F. Novak

It is certified that error appears in the above-identified patent and that said Letters Patent is hereby corrected as shown below:

Col. 6, line 44 (first line of Claim 1), insert -- torch -- after "plasma".

Signed and Sealed this

Fifteenth Day of November, 1988

*Attest:*

DONALD J. QUIGG

*Attesting Officer*

*Commissioner of Patents and Trademarks*